US007183247B2

(12) United States Patent
Sunder et al.

(10) Patent No.: US 7,183,247 B2
(45) Date of Patent: Feb. 27, 2007

(54) METHOD FOR THE PRODUCTION OF SUSPENSIONS COMPRISING PHTHALIMIDOPEROXYHEXANOIC ACID

(75) Inventors: Matthias Sunder, Hilden (DE); Christian Schoth, Ratingen (DE); Theodor Voelkel, Erkrath (DE); Dieter Nickel, Erkrath (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 0 days.

(21) Appl. No.: 11/151,711

(22) Filed: Jun. 13, 2005

(65) Prior Publication Data

US 2005/0233928 A1 Oct. 20, 2005

Related U.S. Application Data

(63) Continuation of application No. PCT/EP2003/013565, filed on Dec. 2, 2003.

(30) Foreign Application Priority Data

Dec. 17, 2002 (DE) ..... 102 59 262

(51) Int. Cl.
*C11D 3/395* (2006.01)

(52) U.S. Cl. ..... 510/375; 510/302; 510/309; 510/337; 510/338; 510/342; 510/367; 510/397; 510/432

(58) Field of Classification Search ..... 510/302, 510/309, 337, 338, 342, 367, 375, 397, 432
See application file for complete search history.

(56) References Cited

U.S. PATENT DOCUMENTS

| | | | | |
|---|---|---|---|---|
| 5,453,214 | A * | 9/1995 | van den Berg et al. | 510/372 |
| 5,480,577 | A * | 1/1996 | Nicholson et al. | 510/372 |
| 5,821,207 | A * | 10/1998 | Kanai et al. | 510/531 |
| 5,858,945 | A * | 1/1999 | Lang et al. | 510/224 |
| 5,981,456 | A * | 11/1999 | Tartakovsky et al. | 510/220 |
| 5,994,284 | A | 11/1999 | Gethöffer et al. | |
| 6,475,977 | B1 * | 11/2002 | Pfeiffer et al. | 510/439 |
| 6,537,958 | B1 * | 3/2003 | Di Capua et al. | 510/310 |
| 6,699,828 | B1 * | 3/2004 | de Buzzaccarini et al. | 510/372 |
| 6,709,647 | B2 * | 3/2004 | Bhakoo et al. | 424/65 |
| 2002/0112741 | A1 * | 8/2002 | Pieroni et al. | 134/6 |

FOREIGN PATENT DOCUMENTS

| | | |
|---|---|---|
| DE | 697 02 923 T2 | 3/2001 |
| EP | 0 325 328 A1 | 7/1989 |
| EP | 0 477 190 B1 | 3/1993 |
| EP | 0 484 095 B1 | 3/1996 |
| EP | 0 442 549 B1 | 10/1996 |
| EP | 0 349 940 B1 | 5/1998 |
| EP | 0 890 635 A2 | 1/1999 |
| EP | 1 010 750 A1 | 6/2000 |
| EP | 1 010 751 A2 | 6/2000 |
| EP | 1 074 607 B1 | 4/2005 |
| WO | WO 98/18835 A1 | 5/1998 |
| WO | WO 00/27960 A2 | 5/2000 |
| WO | WO 00/27969 A1 | 5/2000 |
| WO | WO 00/27971 A1 | 5/2000 |
| WO | WO 00/29536 A1 | 5/2000 |

* cited by examiner

*Primary Examiner*—Charles Boyer
(74) *Attorney, Agent, or Firm*—John E. Drach; Glenn E. J. Murphy

(57) ABSTRACT

A process for the production of a flowable suspension containing phthalimidoperoxyhexanoic acid by combining phthalimidoperoxyhexanoic acid in granular form with a liquid alcohol and grinding the combination to form a flowable suspension of the phthalimidoperoxyhexanoic acid in the alcohol.

10 Claims, No Drawings

METHOD FOR THE PRODUCTION OF SUSPENSIONS COMPRISING PHTHALIMIDOPEROXYHEXANOIC ACID

CROSS REFERENCE TO RELATED APPLICATIONS

This application is a continuation under 35 U.S.C. § 365(c) and 35 U.S.C. § 120 of international application PCT/EP2003/013565, filed Dec. 2, 2003. This application also claims priority under 35 U.S.C. § 119 of DE 102 59 262.4, filed Dec. 17, 2002, which is incorporated herein by reference in its entirety.

BACKGROUND OF THE INVENTION

This invention relates to a process for the production of flowable suspensions containing phthalimidoperoxyhexanoic acid and to their use for the production of liquid detergents or cleaners.

Phthalimidoperoxyhexanoic acid is known, for example, from European patents EP 0 349 940 and EP 0 325 328. Its use in liquid detergents or cleaners is known, for example, from European patent applications EP 0 442 549, EP 0 477 190, EP 0 484 095 or EP 1 010 750 or from International patent applications WO 00/27960, WO 00/27971 or WO 00/29536. In the course of its production from aqueous systems, it is normally obtained in the form of relatively large crystals which are capable of caking together and which are commercially available as so-called "wet cake". The physically stable incorporation of phthalimidoperoxyhexanoic acid in liquid preparations is problematic due, on the one hand, to the size and hence weight of the particles and, on the other hand, to the width of the particle size distribution. International patent application WO 00/27969 describes a two-stage process for grinding the wet cake resulting from the production of phthalimidoperoxyhexanoic acid to mean particle sizes below 100 μm. European patent application EP 0 890 635 recommends grinding phthalimidoperoxyhexanoic acid in acidified water which may also contain defoamers, anionic surfactant, nonionic surfactant, hydrogen peroxide and/or inorganic salts. According to European patent application EP 1 074 607, water-based dispersions of phthalimidoperoxyhexanoic acid can be stabilized by the addition of certain polymers.

It has now surprisingly been found that highly stable liquid suspensions of phthalimidoperoxyhexanoic acid can be obtained in a relatively simple manner by using certain organic liquids instead of water.

The present invention relates to a process for the production of a flowable suspension containing phthalimidoperoxyhexanoic acid by grinding phthalimidoperoxyhexanoic acid in alcoholic suspension.

Grinding may be carried out in typical wet grinding mills. In a preferred embodiment, grinding is carried out in a toothed disk mill or ball mill.

Grinding is preferably continued until the mean particle size ($d_{50}$, as determined with a laser diffraction spectrometer) of the phthalimidoperoxyhexanoic acid is in the range from 10 μm to 40 μm and more particularly in the range from 12 μm to 30 μm. In a preferred embodiment of the invention, grinding is continued until the size of at least 90% of the particles ($d_{90}$, again as determined with a laser diffraction spectrometer) of the phthalimidoperoxyhexanoic acid is under 80 μm and more particularly under 50 μm. Any grinding process is automatically understood to start out from a relatively coarse quality. This relatively coarse quality may be the wet cake already mentioned, which may readily contain particles up to 1 mm in size, or particles produced therefrom by drying and optionally granulation. Any adhering water need not be removed any further and may be introduced with the wet cake into the alcoholic suspension. In this case, the alcohol component of the alcoholic suspension must be correspondingly miscible with water.

It is essential that the alcohol component of the alcoholic suspension should be liquid at the grinding temperature and that the phthalimidoperoxyhexanoic acid should be largely insoluble therein. By "largely insoluble" is meant that the phthalimidoperoxyhexanoic acid dissolves in the alcohol component at most 10 times better, preferably at most 2 times better and, in a particularly preferred embodiment, no better than it does in water. The grinding temperature is preferably room temperature, but may even be higher due to the input of energy during grinding, although it should remain below the boiling point of the alcohol at normal pressure. $C_{1-3}$ alcohols containing up to 3 OH groups and mixtures thereof are particularly suitable.

The alcohol is preferably selected from the group consisting of ethanol, propanol, isopropanol, ethanediol, propane-1,2-diol, glycerol and mixtures thereof.

The content of phthalimidoperoxyhexanoic acid in the alcoholic suspension is preferably in the range from 10% by weight to 90% by weight and more particularly in the range from 50% by weight to 85% by weight.

Flowable, non-sedimenting suspensions of phthalimidoperoxyhexanoic acid in the alcohol component are obtained in the manner described above. By "flowable" is meant that the suspension flows out at least partly from an open, correspondingly tilted vessel under the effect of gravity and can readily be pumped in the course of its industrial subsequent processing.

A suspension obtainable by the process according to the invention is preferably used for the production of liquid detergents or cleaners. A bleach-containing liquid detergent or cleaner containing a suspension obtainable by the process according to the invention may contain water or may be substantially water-free and, apart from the suspension obtainable by the process according to the invention, may contain any other ingredients typical of such preparations providing they do not negatively interact with the phthalimidoperoxyhexanoic acid in an unreasonable manner. A corresponding preparation preferably has an acidic pH which is in the range from pH 2.5 to pH 6.5 and preferably in the range from pH 3.5 to pH 5.5 and may optionally have been adjusted by the presence of system-compatible acids.

A particular advantage worth mentioning is that, by virtue of the process according to the invention, the phthalimidoperoxyhexanoic acid also remains non-sedimenting in the liquid detergents or cleaners.

If desired, other ingredients of the detergents or cleaners may be ground in the same alcoholic suspension and at the same time as the phthalimidoperoxyhexanoic acid providing they can be suspended in the alcohol component in the presence of the phthalimidoperoxyhexanoic acid and are to be ground to the same particle size as the phthalimidoperoxyhexanoic acid.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

EXAMPLES

Example 1

Phthalimidoperoxyhexanoic acid granules (Eureco®, manufacturer: Ausimont) were suspended in isopropyl alcohol. The 70% by weight suspension was intensively sheared for 15 minutes in a grinding bowl by a toothed disk rotating at a peripheral speed of 10 m/s. A free-flowing, pseudoplastic paste B1 was obtained. Particle size analysis in a laser diffraction spectrometer produced the following values: $d_{10}$=4.6 μm, $d_{50}$=20 μm, $d_{90}$=41 μm.

Example 2

Phthalimidoperoxyhexanoic acid granules (Eureco®, manufacturer: Ausimont) were suspended in propane-1,2-diol. The 62.5% by weight suspension was intensively sheared for 12 minutes in a grinding bowl by a toothed disk rotating at a peripheral speed of 14.5 m/s. A free-flowing, pseudoplastic paste was obtained. Particle size analysis in a laser diffraction spectrometer produced the following values: $d_{10}$=2.6 μm, $d_{50}$=13 μm, $d_{90}$=31 μm.

What is claimed is:

1. A process for the production of a flowable suspension containing phthalimidoperoxyhexanoic acid comprising the steps of combining phthalimidoperoxyhexanoic acid in granular form with a liquid alcohol and grinding the combination to form a flowable suspension of the phthalimidoperoxyhexanoic acid in the alcohol.

2. The process of claim 1, wherein the grinding is carried out in a toothed disk mill or a ball mill.

3. The process of claim 1, wherein the alcohol comprises a $C_{1-3}$ alcohol having up to 3 OH groups.

4. The process of claim 1, wherein the alcohol is selected from the group consisting of ethanol, propanol, isopropanol, ethanediol, propane-1,2-diol, glycerol, and mixtures thereof.

5. The process of claim 1, wherein the content of phthalimidoperoxyhexanoic acid in the alcoholic suspension is 10% by weight to 90% by weight.

6. The process of claim 5, wherein the content of phthalimidoperoxyhexanoic acid in the alcoholic suspension is 50% by weight to 85% by weight.

7. The process of claim 1, wherein the phthalimidoperoxyhexanoic acid granules are ground to a mean particle size of $d_{50}$ of 10 μm to 40 μm.

8. The process of claim 7, wherein the phthalimidoperoxyhexanoic acid granules are ground to a mean particle size $d_{50}$ of 12 μm to 30 μm.

9. The process of claim 1, wherein the phthalimidoperoxyhexanoic acid granules are ground to a size distribution wherein at least 90% of the particles ($d_{90}$) are under 80 μm.

10. The process of claim 9, wherein the phthalimidoperoxyhexanoic acid granules are ground to a size distribution wherein at least 90% of the particles ($d_{90}$) are under 50 μm.

* * * * *